US005417878A

United States Patent [19]

Takahata et al.

[11] Patent Number: 5,417,878

[45] Date of Patent: May 23, 1995

[54] SOLID DETERGENT COMPOSITION

[75] Inventors: Masahiro Takahata, Ichikawa; Toshiya Morikawa, Chiba; Toshio Nozaki, Sakaemachi; Hiroshi Nakamatsu, Soka, all of Japan

[73] Assignee: Kao Corporation, Tokyo, Japan

[21] Appl. No.: 125,132

[22] Filed: Sep. 23, 1993

Related U.S. Application Data

[63] Continuation of Ser. No. 848,063, Mar. 9, 1992, abandoned.

[30] Foreign Application Priority Data

Mar. 7, 1991 [JP] Japan ..... 3-041869

[51] Int. Cl.[6] ..... C11D 9/06; C11D 9/00

[52] U.S. Cl. ..... 252/174; 252/DIG. 5; 252/DIG. 16; 252/128; 252/133; 252/174.25

[58] Field of Search ..... 252/124, DIG. 5, DIG. 16, 252/128, 174.25, 133

[56] References Cited

U.S. PATENT DOCUMENTS

| | | | |
|---|---|---|---|
| 1,615,146 | 1/1927 | Spindler | 252/131 |
| 2,781,320 | 2/1957 | Jelinek et al. | 252/DIG. 16 |
| 2,781,321 | 2/1957 | Mayhew et al. | 252/DIG. 16 |
| 2,894,912 | 7/1959 | Gelt | 252/121 |
| 3,070,547 | 12/1962 | Chaffee | 252/121 |
| 3,247,121 | 4/1966 | Hendricks | 252/117 |
| 3,576,249 | 4/1971 | Megson et al. | 252/132 |
| 3,723,329 | 3/1973 | Evans | 252/121 |
| 4,133,779 | 1/1979 | Hellyer et al. | 252/547 |
| 4,151,105 | 4/1979 | O'Roark | 252/145 |
| 4,181,632 | 1/1980 | Schebece | 252/542 |
| 4,234,464 | 11/1980 | Morshauser | 252/544 |
| 4,347,153 | 8/1982 | Hooper et al. | 252/174.25 |
| 4,443,355 | 4/1984 | Murata | 252/174.12 |
| 4,469,848 | 9/1984 | Hooper et al. | 252/106 |
| 4,534,892 | 8/1985 | Suzuki et al. | 252/545 |
| 4,557,853 | 12/1985 | Collins . | |
| 4,681,704 | 7/1987 | Bernadino et al. | 252/546 |
| 4,719,030 | 1/1988 | Williams et al. | 252/133 |
| 5,041,233 | 8/1991 | Kutny et al. | 252/121 |

FOREIGN PATENT DOCUMENTS

| | | |
|---|---|---|
| 58-167700 | 10/1983 | Japan . |
| 58-191799 | 11/1983 | Japan . |
| 61-275394 | 12/1986 | Japan . |
| 62-43497 | 2/1987 | Japan . |
| 62-70308 | 3/1987 | Japan . |
| 62-199699 | 9/1987 | Japan . |

*Primary Examiner*—Paul Lieberman
*Assistant Examiner*—Michael P. Tierney
*Attorney, Agent, or Firm*—Oblon, Spivak, McClelland, Maier & Neustadt

[57] ABSTRACT

A solid detergent composition such as soap which contains 0.02 to 5.0% by weight of magnesium oxide and/or calcium oxide based on the total weight of the composition.

7 Claims, No Drawings

SOLID DETERGENT COMPOSITION

This application is a continuation of application Ser. No. 07/848,063, filed on Mar. 9, 1992, now abandoned.

BACKGROUND OF THE INVENTION

1. Field of the Invention

This invention relates to a solid detergent composition, more particularly to a solid detergent composition which maintains its shape during use with no swelling, liquidification or cracking and which has a refreshing feel and good detergency.

2. Description of the Background Art

Typical solid detergents include 1) standard soap which is an alkali salt of a higher fatty acid, 2) combar which is a soap containing a synthetic surfactant, and 3) syndet bar which is prepared by binding synthetic surfactants with a binder.

Standard soaps are generally prepared either by allowing a mixture of oils and/or fats such as beef tallow and coconut oil to react with an aqueous solution of caustic soda, or by a method where a fatty acid mixture obtained from the decomposition of beef tallow, coconut oil and the like is neutralized with caustic soda, caustic potash, alkanolamine or the like to obtain a soap base, followed by the addition of perfumes and colorants. Recently, super-fat soaps which contain a free fatty acid have become the main product of the industry. The synthetic surfactants which are contained in a combar and a syndet bar include isethionic esters, alcohol sulfate, alcohol phosphate and N-acylglutamate.

Solid detergent compositions are essentially water-soluble, and therefore, they absorb water when they are repeatedly used in the bath, in lavatories and the like. This water absorption causes swelling, induces softening and melt-off, and brings about the occurrence of cracks, all resulting in a composition with unfavorable appearance and texture. Furthermore, the softening/swelling of a detergent article leads to deteriorated foam-producing ability and detergency.

Heretofore, only a few studies have been reported regarding the prevention of swelling, softening and melt-off, and the occurrence of cracks of solid detergent compositions: Japanese patent application laid-open to the public (Kokai) No. 58-167700 discloses a solid detergent composition having a cationic polymer and Japanese patent application laid-open to the public (Kokai) No. 62-199699 discloses a solid detergent composition having lactic acid or its salts. These detergent additives, however, are water-soluble, and therefore they are useless for preventing the above-mentioned defects like swelling.

Talc powder or kaolin powder has been incorporated into solid detergent compositions in an attempt to improve detergency and feel upon use. In this regard, U.S. Pat. No. 4557853 discloses a solid detergent composition incorporating calcium carbonate Japanese patent application lad-open to the public (Kokai) Nos. 58-191799, 62-43497, 62-70308 and others disclose solid detergent compositions incorporating an organic powder; and Japanese patent application laid-open to the public (Kokai) No. 61-275394 discloses a solid detergent composition incorporating water-insoluble synthetic amorphous granular silica or silicate. However, none of these additives prevented the detergent compositions form being softened/swollen, from melting off and softening or cracking, though the detergency and feel upon use were improved.

Accordingly, solid detergent compositions which will not be softened/swollen, not show melt-off, and not crack during use which also provide a refreshing feeling and excellent detergency are still sought after. Under these circumstances, the present inventors have conducted careful studies and have found that when specified metal oxides are incorporate into a solid detergent composition singly or in combination, the above-mentioned problems could be solved. The present invention was achieved based on this finding.

SUMMARY OF THE INVENTION

Accordingly, a object of this invention is to provide a solid detergent composition containing 0.02 to 5.0% by weight, based on the total weight of the composition, of magnesium oxide and/or calcium oxide.

The above and other objects, features and advantages of the present invention will become apparent from the following description.

DETAILED DESCRIPTION OF THE INVENTION AND PREFERRED EMBODIMENTS

The magnesium oxide and calcium oxide which are useful in this invention are not specifically limited, and are generally a available from the market. The particle size range of the oxides is preferably between 100 and 0.1 micrometers, more preferably between 50 and 0.1 micrometers.

According to the present invention, magnesium oxide and/or calcium oxide is incorporated into the detergent singly or in combination. The general blending amount, in total, is 0.02 to 5.0% by weight based on the total detergent composition. When the detergent composition is a soap, the preferred amount is 0.05 to 2.0% by weight, more preferably, 0.1 to 0.5% by weight. When the solid detergent composition is a combar or a syndet bar, the preferred amount is 0.1 to 2.0% by weight, more preferably 0.1 to 1.0% by weight. An amount less than 0.01% by weight is insufficient in bringing about the beneficial effects of the present invention, and an amount more than 5.0% by weight causes a problem in the solidity of the composition during manufacture.

The effects of the invention, namely the prevention of softening/swelling, melt-off and the occurrence of cracks in solid detergent compositions can be enhanced by further incorporating magnesium chloride and/or calcium chloride, singly or in combination, into the solid detergent composition in an amount such that the proportions of magnesium oxide/magnesium chloride and calcium oxide/calcium chloride each fall in the range of from 5/1 to 10/1, and more preferably, from 7/1 to 9/1. For compositions comprising only MgO and $CaCl_2$ with no $MgCl_2$ or CaO, the proportion of MgO/$CaCl_2$ also falls in the range of from 5/1 to 10/1, preferably 7/1 to 9/1. Similarly, for compositions comprising only CaO and $MgCl_2$ with no MgO or $CaC_2$, the proportions of CaO/$MgCl_2$ is 5/1 to 10/1, preferably 7/1–9/1. For those compositions with to oxides and one chloride, or one oxide and two chlorides, the proportion of total oxide/total chloride is 5/1 to 10/1, preferably 7/1 to 9/1. When magnesium chloride and calcium chloride are used together, the total amount of the magnesium oxide and calcium oxide is preferably from 0.1 to 2.0% by weight, and more preferably from 0.1 to 1.0% by weight for the manufacture of soaps. On the other hand, for the manufacture of combars and syndet bars, the total amount of MgO and CaO is preferably 0.1 to 3.0% by weight, and more preferably 0.1 to 2.0% by weight.

The solid detergent compositions according to the present invention can be manufactured by blending the mentioned ingredients with a soap base such as soap tips, and molding. In more detail, in the manufacture of soaps, a soap base is first prepared either by saponifying vegetable oils/fats typified by coconut oil, palm oil, palm kernel oil, soy bean oil, olive oil and cotton oil; or animal oils/fats typified by beef tallow and lanolin with caustic soda, or by neutralizing the decomposition products of these oils/fats with caustic soda, caustic potash, alkanolamine or the like. Then, the obtained soap base is added with magnesium oxide and/or calcium oxide, and if desired, with magnesium chloride and/or calcium chloride and blended, kneaded, extruded and molded.

For the manufacture of combars, the soap base is first blended with an alkali metal salt of alpha-sulfo fatty acid ester, isethionic ester, alkyl aryl sulfonic acid, alcohol sulfate, a sulfuric acid ester of alcohol ethoxylate, olefinic sufonic acid, paraffin sulfonic acid, alcohol phosphate, N-acylglutamic acid and N-acyl compounds of formula (I):

$$R'CONH(CH_2)_nCOOH \quad (I)$$

wherein R'CO is an acyl group having 10 to 16 carbon atoms and n is a number of 1 or 2; or alkyl betaine, sufobetaine and the like. Among these, salts of an N-acyl compound of formula (I), especially $R'CONH(CH_2)_nCOON_a$, and a salt of isethionic ester are preferred from the viewpoint of the feeling to the touch. Then, magnesium oxide and/or calcium oxide is added thereto, and if desired, magnesium chloride and/or calcium chloride is farther added, blended, kneaded, extruded and molded.

For the manufacture of syndet bars, besides the above-mentioned synthetic surfactants, higher fatty acids such as myristic acid palmitic acid, stearic acid, or higher alcohols such as myristyl alcohol, cetyl alcohol, stearyl alcohol and the like are further incorporated as binders; and water is added with blending under heat. The composition is then cooled down to prepare pellets. The obtained pellets are added together with magnesium oxide and/or calcium oxide, and if desired, magnesium chloride and/or calcium chloride, then blended, kneaded, extruded and molded.

The solid detergent composition of this invention can further contain effective amounts of other compatible components which are generally used in this technical field, which include superfatting agents generally incorporated into ordinary skin detergent compositions such as higher fatty acid esters and silicones, moisturizers such as propylene glycol, glycerol, etc., perfumes, colorants, UV absorbers, antioxidants, germicides, antiseptics, etc.

This invention will now be further illustrated by way of examples which should not be construed as limiting the invention in any manner.

Examples

In the following examples, tests were conducted as described below, and valuations of swelling and the occurrence of cracks were made in accordance with the processes and criteria in (1), (2) and (3), respectively.

(1) Test of swelling degree: .

Test pieces (1×1×5 cm) of the solid detergent compositions described in Tables 1 and 2 were provided. They were soaked in 25° C. water for 4 hours, then taken out and placed on a rheometer (product of Fudo Kogyo K.K., NRM-2010J-CW). A needle pressure element was inserted from one surface of each of the test pieces, and the distance between the surface and the point where 100 g resistance was obtained was measured. The swelling degree was calculated from the following equation:

(Swelling degree)=
(Distance after soaked) - (Distance before soaked)

The larger the value, the greater the swelling.

(2 ) Human evaluation of swelling:

The solid detergent compositions in Tables 1 and 2 were used in a bath under the same conditions for two weeks, and the state of the test compositions were visually evaluated.

The evaluation standards were as follows:

A: No swelling
B: Slight swelling
C: Moderate swelling.
D: Significant swelling

(3) Evaluation of crack occurrence

Test pieces (1×1×5 cm) of the solid detergent compositions were provided, and were soaked in 25° C. water for 4 hours. They were taken out and dried for 24 hours at room temperature. Cracks were visually checked. The evaluation standards were as follows:

A: No cracks
B: Slight number of cracks
C: Moderate number of cracks
D: Many cracks

Example 1

Soaps formulated as shown in Table 1 were prepared as described above by blending, kneading, extruding and molding the components, and each of them was tested for swelling degree, swelling by human evaluation, and the occurrence of cracks. The results are shown in Table 1.

TABLE 1

(% by weight)

| | Present invention | | | | | | Comparative products | | | | | |
|---|---|---|---|---|---|---|---|---|---|---|---|---|
| | 1 | 2 | 3 | 4 | 5 | 6 | 1 | 2 | 3 | 4 | 5 | 6 |
| Soap base (beef tallow/ coconut oil = 8/2, water = 13%) | balance | balance | balance | balance | balance | balance | balance | balance | balance | balance | balance | balance |
| Coconut oil fatty acid | 5.0 | 5.0 | 5.0 | 5.0 | 5.0 | 5.0 | 5.0 | 5.0 | 5.0 | 5.0 | 5.0 | 5.0 |
| Magnesium oxide | 0.2 | 0.5 | | 0.15 | | 0.15 | | | | | 0.01 | 6.0 |
| Calcium oxide | | | 0.3 | | 0.2 | 0.15 | | | | | | |

TABLE 1-continued

| | (% by weight) Present invention | | | | | | Comparative products | | | | | |
|---|---|---|---|---|---|---|---|---|---|---|---|---|
| | 1 | 2 | 3 | 4 | 5 | 6 | 1 | 2 | 3 | 4 | 5 | 6 |
| Magnesium chloride | | | | 0.02 | | | | | | | | |
| Calcium chloride | | | | | 0.03 | | | | | | | |
| Silica | | | | | | | | 1.0 | | | | |
| Zeolite | | | | | | | | | 1.0 | | | |
| Talc | | | | | | | | | | 1.0 | | |
| Degree of swelling (mm) | 1.88 | 1.78 | 1.94 | 1.69 | 1.72 | 1.68 | 2.56 | 2.32 | 2.50 | 2.54 | 2.55 | uncapable of solidification |
| Swelling by visual judgement | A | A | B | A | A | A | C | C | C | C | C | uncapable of solidification |
| Occurrence of cracks | A | A | A | A | A | A | D | D | D | D | D | uncapable of solidification |

Example 2

Combars and syndet bars formulated from the components listed in Table 2 were prepared as described above, and each of them was tested for swelling degree, swelling by human evaluation, and the occurrence of cracks. The results are also shown in Table 2.

-continued

| (Components) | (wt. %) |
|---|---|
| Stabilizer (dibutyl hydroxytoluene) | 0.05 |
| Perfume | 1.0 |
| Magnesium oxide | 0.2 |
| Magnesium chloride | 0.02 |

TABLE 2

| | (% by weight) Present invention | | | | | | | | | | Comparative products | |
|---|---|---|---|---|---|---|---|---|---|---|---|---|
| | 7 | 8 | 9 | 10 | 11 | 12 | 13 | 14 | 15 | 16 | 7 | 8 |
| Sodium cocoyl isethionate | balance | balance | balance | balance | balance | | | | | | balance | |
| Sodium lauroyl-β-alanine | | | | | | balance | balance | balance | balance | balance | | balance |
| Coconut oil fatty acid | 10.0 | 110.0 | 110.0 | 110.0 | 110.0 | 110.0 | 110.0 | 110.0 | 110.0 | 110.0 | 110.0 | 110.0 |
| Stearic acid | 20.0 | 20.0 | 20.0 | 20.0 | 20.0 | 20.0 | 20.0 | 20.0 | 20.0 | 20.0 | 20.0 | 20.0 |
| Magnesium oxide | 0.5 | | 0.15 | | 0.2 | 0.5 | | 0.15 | | 0.2 | | |
| Calcium oxide | | 0.5 | | 0.2 | 0.2 | | 0.5 | | 0.3 | 0.2 | | |
| Magnesium chloride | | | 0.02 | | | | | 0.02 | | | | |
| Calcium chloride | | | | 0.02 | | | | | 0.03 | | | |
| Purified water | 10.0 | 10.0 | 10.0 | 10.0 | 10.0 | 10.0 | 10.0 | 10.0 | 10.0 | 10.0 | 10.0 | 10.0 |
| Degree of swelling (mm) | 1.72 | 1.81 | 1.69 | 1.75 | 1.63 | 1.75 | 1.80 | 1.74 | 1.78 | 1.66 | 2.87 | 3.72 |
| Swelling by visual judgement | A | A | A | A | A | A | A | A | A | A | D | D |
| Occurrence of cracks | A | A | A | A | A | A | A | A | A | A | D | D |

Example 3 (Soap)

A soap having the following composition was prepared:

| (Components) | (wt. %) |
|---|---|
| Soap base (beef tallow/coconut oil = 8/2, water 13%) | balance |
| Coconut oil fatty acid | 5.0 |
| Pigment (titanium oxide) | 0.1 |
| Stabilizer (dibutyl hydroxytoluene) | 0.05 |
| Perfume | 1.0 |
| Magnesium oxide | 0.15 |
| Magnesium chloride | 0.02 |

It was evaluated in terms of swelling and occurrence of cracks, and found to be excellent.

Example 4 (Syndet Bar)

A solid detergent composition of the following formulation was prepared:

| (Components) | (wt. %) |
|---|---|
| Sodium cocoyl isethionate | balance |
| Coconut oil fatty acid | 10.0 |
| Stearic acid | 20.0 |
| Pigment (titanium oxide) | 0.1 |

It was evaluated in terms of swelling and occurrence of cracks, and found excellent.

Example 5 (Syndet Bars)

The solid detergent compositions (a), (b) of the following formulations were prepared:

| (Components) | (a) (wt. %) | (b) (wt. %) |
|---|---|---|
| Sodium lauroyl-β-alanine | 60.0 | 72.0 |
| Lauric acid | 5.0 | 4.0 |
| Palmitic acid | 10.0 | — |
| Stearic acid | 15.0 | — |
| Coconut oil fatty acid | — | 12.0 |
| Palmityl alcohol | — | 1.5 |
| Stearyl alcohol | — | 1.5 |
| Stabilizer (dibutyl hydroxytoluene) | 0.05 | 0.05 |
| Perfume | 1.15 | 1.15 |
| Pigment (titanium oxide) | 0.30 | 0.30 |
| Magnesium oxide | 0.15 | 0.15 |
| Magnesium chloride | 0.02 | 0.02 |
| Water | balance | balance |

They were evaluated in terms of swelling and occurrence of cracks, and found excellent.

As is apparent from the test results, the solid detergent composition of the present invention show excellent properties: swelling is avoided, the tendency towards softening and melt-off is avoided, and the occurrence of cracks is avoided. Further, the present compositions provide a favorable refreshing feeling and excellent detergency upon use.

What is claimed is:

1. A solid soap composition consisting essentially of: soap;

(A) 5 to 30 wt. % of free carboxylic fatty-acid;

(B) 0.02 to 5.0 wt. % of MgO.

(C) optionally, up to about 13 wt. % of water; and (D) the balance being soap.

2. The composition of claim 1, wherein said MgO is present in an amount of 0.15–0.5 wt. %.

3. The composition of claim 1, wherein said free fatty carboxylic acid is present in an amount of 5.0 wt. %.

4. A solid soap composition consisting of:

(A) soap;

(B) 5 to 30 wt % of free fatty carboxylic acid;

(C) 0.02 to 5.0 wt % of MgO;

(D) optionally, pigment;

(E) optionally, dibutyl hydroxytoluene; and (F) optionally, perfume.

5. The solid soap composition of claim 4, wherein said MgO is present in an amount of 0.15–0.5 wt %.

6. The composition of claim 4, wherein said free fatty carboxylic acid is present in an amount of 5.0 wt %.

7. The composition of claim 4, wherein said composition includes pigment, and wherein said pigment is titanium oxide.

* * * * *